US009322571B2

(12) United States Patent
Lee

(10) Patent No.: US 9,322,571 B2
(45) Date of Patent: Apr. 26, 2016

(54) HEATING SYSTEM HAVING PLASMA HEAT EXCHANGER

(71) Applicant: Titan Armor LLC, Oregon City, OR (US)

(72) Inventor: Chris Lee, Oregon City, OR (US)

(73) Assignee: LV Dynamics LLC, Milwaukie, OR (US)

( * ) Notice: Subject to any disclaimer, the term of this patent is extended or adjusted under 35 U.S.C. 154(b) by 384 days.

(21) Appl. No.: 13/671,460

(22) Filed: Nov. 7, 2012

(65) Prior Publication Data

US 2013/0121671 A1 May 16, 2013

Related U.S. Application Data

(60) Provisional application No. 61/558,949, filed on Nov. 11, 2011.

(51) Int. Cl.

| | |
|---|---|
| ***F24H 1/10*** | (2006.01) |
| ***H05B 3/78*** | (2006.01) |
| ***F24H 1/00*** | (2006.01) |
| ***F24H 1/16*** | (2006.01) |
| ***F24H 1/22*** | (2006.01) |
| ***F24H 1/28*** | (2006.01) |
| ***F24H 9/00*** | (2006.01) |
| ***F24H 9/18*** | (2006.01) |
| ***H05H 1/48*** | (2006.01) |
| ***F28D 7/02*** | (2006.01) |

(52) U.S. Cl.

CPC ..... *F24H 1/0018* (2013.01); *F24H 1/162* (2013.01); *F24H 1/225* (2013.01); *F24H 1/287* (2013.01); *F24H 9/0021* (2013.01); *F24H 9/1818* (2013.01); *F28D 7/024* (2013.01); *H05H 1/48* (2013.01); *F24H 2250/10* (2013.01)

(58) Field of Classification Search

None

See application file for complete search history.

(56) References Cited

U.S. PATENT DOCUMENTS

| | | | | | |
|---|---|---|---|---|---|
| 2,775,683 | A | * | 12/1956 | Kleist | 392/398 |
| 2,862,099 | A | * | 11/1958 | Gage | 219/74 |
| 3,585,434 | A | * | 6/1971 | Kato et al. | 313/161 |
| 4,082,914 | A | * | 4/1978 | Bortnichuk et al. | 373/22 |
| 4,286,140 | A | * | 8/1981 | Dewulf et al. | 392/493 |
| 4,641,631 | A | * | 2/1987 | Jatana | 126/101 |

(Continued)

FOREIGN PATENT DOCUMENTS

| | | |
|---|---|---|
| DE | 102009013196 | 9/2010 |
| JP | 05-060384 | 3/1993 |

(Continued)

OTHER PUBLICATIONS

PCT International Search Report and Written Opinion, PCT/US2012/063976, 7pp. (Mar. 28, 2013).

*Primary Examiner* — Thor Campbell

(74) *Attorney, Agent, or Firm* — Klarquist Sparkman, LLP

(57) ABSTRACT

Systems and methods for heating a fluid are disclosed. In certain embodiments, plasma is generated and passed through a conduit. A fluid to be heated can be passed over the conduit, thereby inducing a heat transfer from the plasma to the fluid. In certain embodiments, multiple plasma generators and corresponding conduits are provided and the conduits are positioned within a housing, facilitating a more effective heat transfer. In some embodiments, the plasma generator includes an outer shell, an anode, a cathode, and insulating elements, and generates plasma by passing a gas through an electric arc created between the anode and the cathode.

15 Claims, 22 Drawing Sheets

(56) References Cited

U.S. PATENT DOCUMENTS

| | | | | | |
|---|---|---|---|---|---|
| 4,766,883 | A | * | 8/1988 | Cameron et al. | 122/14.21 |
| 4,782,815 | A | * | 11/1988 | Friedman et al. | 122/18.4 |
| 4,823,770 | A | * | 4/1989 | Loeffler | 122/15.1 |
| 4,993,402 | A | * | 2/1991 | Ripka | 122/18.2 |
| 4,995,805 | A | * | 2/1991 | Hilliard | 431/10 |
| 5,052,345 | A | | 10/1991 | Bystrom et al. | |
| 5,076,494 | A | * | 12/1991 | Ripka | 237/19 |
| 5,228,505 | A | | 7/1993 | Dempsey | |
| 5,271,086 | A | * | 12/1993 | Kamiyama et al. | 392/483 |
| 5,559,924 | A | * | 9/1996 | Kadotani et al. | 392/483 |
| 5,590,240 | A | * | 12/1996 | Rezabek | 392/483 |
| 5,685,997 | A | | 11/1997 | LoPresti | |
| 5,740,315 | A | * | 4/1998 | Onishi et al. | 392/489 |
| 5,988,280 | A | | 11/1999 | Crawford et al. | |
| 6,073,695 | A | | 6/2000 | Crawford et al. | |
| 6,136,593 | A | * | 10/2000 | Custer et al. | 435/297.4 |
| 6,205,292 | B1 | * | 3/2001 | Pokorny et al. | 392/489 |
| 7,112,759 | B1 | | 9/2006 | Severance, Jr. | |
| 7,565,065 | B2 | * | 7/2009 | Kato | 392/311 |
| 8,118,239 | B2 | * | 2/2012 | Robinson | 237/12.3 B |
| 2006/0144347 | A1 | | 7/2006 | Farrell | |
| 2006/0196631 | A1 | | 9/2006 | Small et al. | |
| 2010/0181045 | A1 | | 7/2010 | Bognarne Fejes | |
| 2012/0275775 | A1 | * | 11/2012 | Iskrenovic | 392/483 |
| 2013/0082034 | A1 | * | 4/2013 | Foret | 219/121.52 |

FOREIGN PATENT DOCUMENTS

| | | |
|---|---|---|
| KR | 10-2003-0052608 | 6/2003 |
| KR | 10-0456667 | 11/2004 |
| KR | 10-2011-0032551 | 3/2011 |
| WO | WO 2007/009336 | 1/2007 |

* cited by examiner

HEATING SYSTEM HAVING PLASMA HEAT EXCHANGER

CROSS REFERENCE TO RELATED APPLICATION

This application claims the benefit of U.S. Provisional Patent Application No. 61/558,949, filed Nov. 11, 2011, which is hereby incorporated herein by reference.

FIELD

The present disclosure concerns embodiments of a heating assembly that incorporates one or more plasma generators for heating a fluid.

BACKGROUND

A heat exchanger is a device designed to transfer heat from a first substance to a second, thereby decreasing the heat content of the first substance and increasing the heat content of the second. Heat exchangers have various industrial and commercial applications, including use in power plants, refrigerators, automobile radiators, etc., and various configurations of heat exchangers are known in the art. Methods of heating fluids have various specific applications which include heating cleaning fluids for treating a well bore or pipeline, and heating gases or liquids for use in fracking operations. In at least some of these applications, fluid-heating devices may need to be used in remote and/or numerous locations in a short time span. While many configurations of heat exchangers and devices for heating fluids are known, there is always a need for improvements in efficiency, capacity, portability, and other relevant characteristics of these devices.

Plasma is a state of matter distinct from the traditionally known liquid, gas, and solid states. Generally speaking, it is a gas whose particles have been ionized. Plasma can be created by various natural and artificial methods, including by the exposure of a gas to extreme heat and/or magnetic fields. Methods of generating and using plasma include, as examples, plasma globes, plasma television screens, fluorescent lamps, neon signs, and arc welding. In arc welding, an electric current is passed through the air between two spaced apart pieces of conductive material, thereby creating an electric arc (a very high temperature plasma) between them. Thus, in arc welding, an electric current is used to create a high temperature plasma which can heat and melt the materials to be welded.

Accordingly, it would be desirable to provide improved methods of generating high temperature plasma. Additionally, it would be advantageous to provide improved methods and devices for heating fluids utilizing the heat of high temperature plasma. Improvements in efficiency, capacity, and portability of such methods and devices would all be valuable.

SUMMARY

Disclosed herein are embodiments of an invention allowing the generation of high-temperature plasma and its use for heating a fluid by heat exchange. In some embodiments, a plasma generator comprises an anode and a cathode between which an electrical potential difference can be established. A gas, such as air, is passed between the anode and the cathode, and an electric arc (a high temperature plasma) is created between the electrodes and through the gas. The high temperature plasma and/or high temperature exhaust gases can extend through a conduit over which a fluid to be heated flows, thereby allowing a heat exchange between the plasma and the fluid. Certain embodiments provide a coolant to flow within the anode and/or the cathode to protect against overheating. Certain embodiments utilize a plurality of plasma generators and a plurality of conduits. Certain embodiments utilize supplementary heat exchangers which use engine coolant, engine exhaust, or plasma exhaust to pre-heat the fluid to be heated before it flows over the conduit.

In one embodiment, a heating apparatus includes plural plasma generators and plural conduits, each conduit extending from a plasma generator and configured to receive plasma and/or plasma exhaust therefrom. Each conduit can comprise a burn chamber and a coil, with each burn chamber extending from a respective plasma generator and each coil extending from a respective burn chamber. A conduit housing can be provided which surrounds the conduits, and through which a fluid to be heated can flow. In some embodiments, an insert extends through the coils within the conduit housing such that a smaller volume of water passes through the conduit housing.

In another embodiment, a method comprises generating plasma within a burn chamber that is surrounded by a housing. A fluid is allowed to flow through the housing and over the burn chamber, thereby receiving heat from the plasma. The generation of plasma may be cyclical or periodic, such that the plasma generator is not constantly generating plasma. If multiple plasma generators are utilized, their cycles may be coordinated such that plasma is constantly generated by at least one of the generators.

In yet another embodiment, a plasma generator comprises a casing, an outer insulator positioned coaxially within the casing, a cathode positioned coaxially within the outer insulator, an inner insulator positioned coaxially within the cathode, and an anode positioned coaxially within the inner insulator. A difference in electrical potential can be established between the anode and the cathode, and thus an electric arc can be generated when a gas is passed between them. The inner insulator can have air channels extending along its length to allow a gas to be provided to the gap between the electrodes. The cathode and the anode can be provided with ducts or channels for allowing a coolant fluid (e.g., water) to flow through, in order to protect against overheating of the various components. Materials, components, and configurations can additionally be selected to increase the transfer of heat from the electrodes to the coolant fluid to further protect against overheating.

The disclosed embodiments should not be construed as limiting in any way. Instead, the present disclosure is directed toward all novel and nonobvious features and aspects of the various disclosed embodiments, alone or in various combinations and sub-combinations with one another.

DETAILED DESCRIPTION

Figure 1:
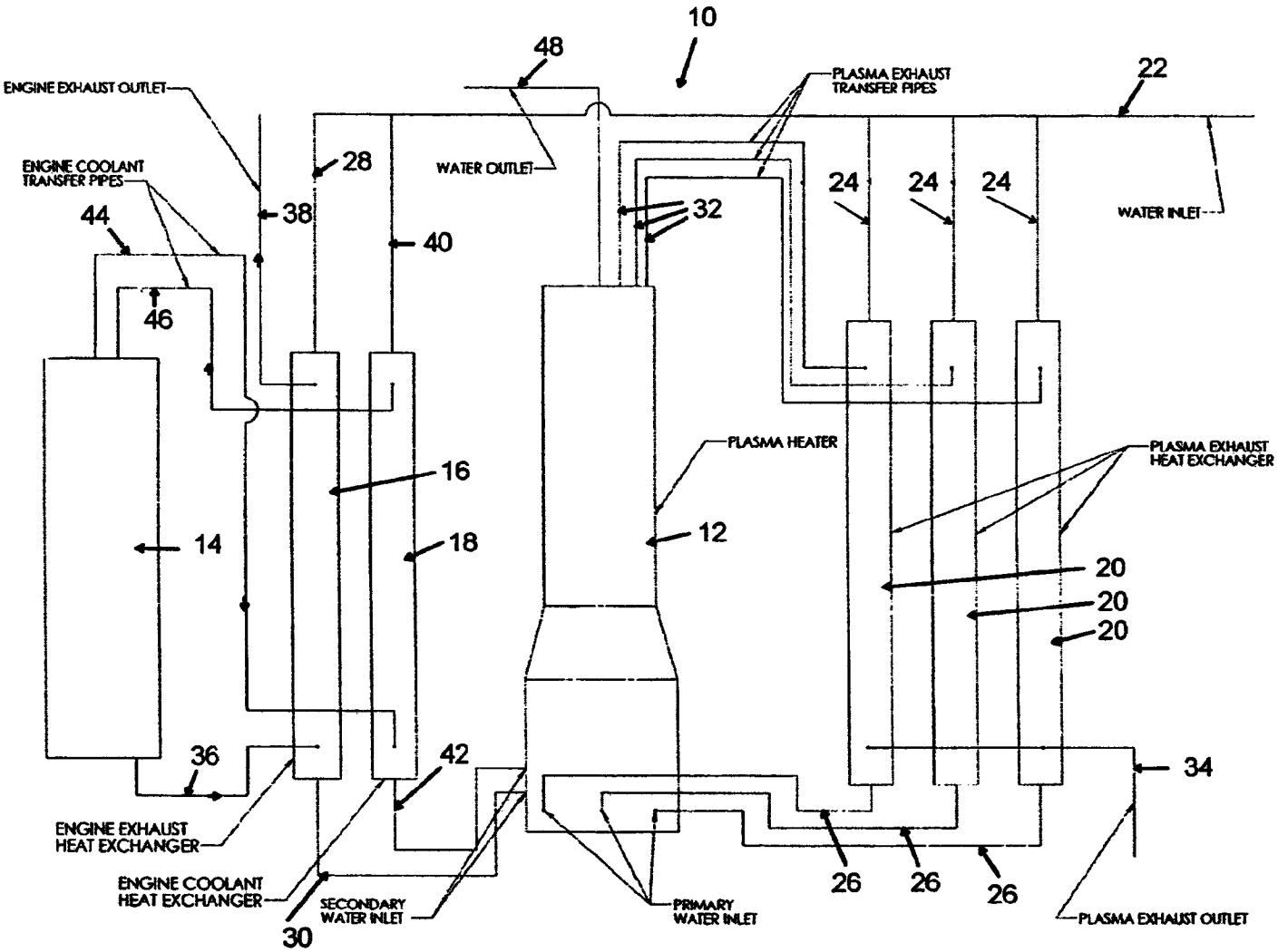
FIG. 1 is a schematic view of a heating assembly for heating a fluid, according to one embodiment.

FIG. 1 is a schematic view of a heating assembly 10, according to one embodiment. The heating assembly 10 in the illustrated embodiment generally includes a plasma heat exchanger 12, an engine driven electrical generator 14 (e.g., a generator with a diesel engine) that supplies electrical current to the plasma heat exchanger, an engine exhaust heat exchanger 16, an engine coolant heat exchanger 18, and one or more plasma exhaust heat exchangers 20. The plasma exhaust heat exchangers 20 receive heated exhaust gases from the plasma heat exchanger 12 for preheating a fluid flowing into the plasma heat exchanger. The engine exhaust heat exchanger 16 receives exhaust gases from the generator's engine for preheating the fluid flowing into the plasma heat exchanger. The engine coolant heat exchanger 18 receives the coolant liquid from the generator's engine and the fluid flowing into the plasma heat exchanger. The inlet fluid to the plasma heat exchanger 12 cools the engine coolant liquid in the engine coolant heat exchanger 18.

The heating assembly 10 can be used to heat any type of fluid, including without limitation, liquids, such as water, diesel fuel, or kerosene, and gases, such as nitrogen, to name a few. For purposes of description, the heating assembly 10 will be described in the context of heating water, although the assembly can be used to heat other fluids.

In use, water to be heated in the plasma heat exchanger 12 enters the assembly via an inlet conduit 22 (e.g., pipe). A portion of the inlet water can be directed to flow through respective conduits 24, respective plasma exhaust heat exchangers 20, and respective conduits 26, and then into the plasma heat exchanger 12. Hot exhaust gases from the plasma heat exchanger 12 flow through respective conduits 32, respective plasma exhaust heat exchangers 20, and then through an exhaust manifold 34 that exhausts the gases to atmosphere. Inlet water flowing through plasma exhaust heat exchangers 20 therefore is pre-heated by the hot exhaust gas from the plasma heat exchanger.

A portion of the inlet water also can be directed to flow through a conduit 28, the engine exhaust heat exchanger 16, a conduit 30, and then into the plasma heat exchanger 12. Hot exhaust gases from the generator's engine flows through conduit 36, the engine exhaust heat exchanger 16, and then an exhaust conduit 38, which vents the exhaust gases to atmosphere. Inlet water flowing through the engine exhaust heat exchanger 16 therefore is preheated by the hot exhaust gases from the generator's engine.

A portion of the inlet water also can be directed to flow through a conduit 40, the engine coolant heat exchanger 18, a conduit 42, and then into the plasma heat exchanger 12. The engine coolant from the generator's engine (e.g., water or a water/antifreeze mixture) circulates through the engine coolant heat exchanger 18 via conduits 44, 46 to be cooled by the inlet water flowing into the plasma heat exchanger. Inlet water directed into the plasma heat exchanger via conduits 26, 30, and 42 is heated by plasma inside the plasma heat exchanger 12, as described in detail below. Heated water exits the plasma heat exchanger through an outlet conduit 48, from which the heated water can be directed to one or more users or processes requiring heated water.

Figure 7:
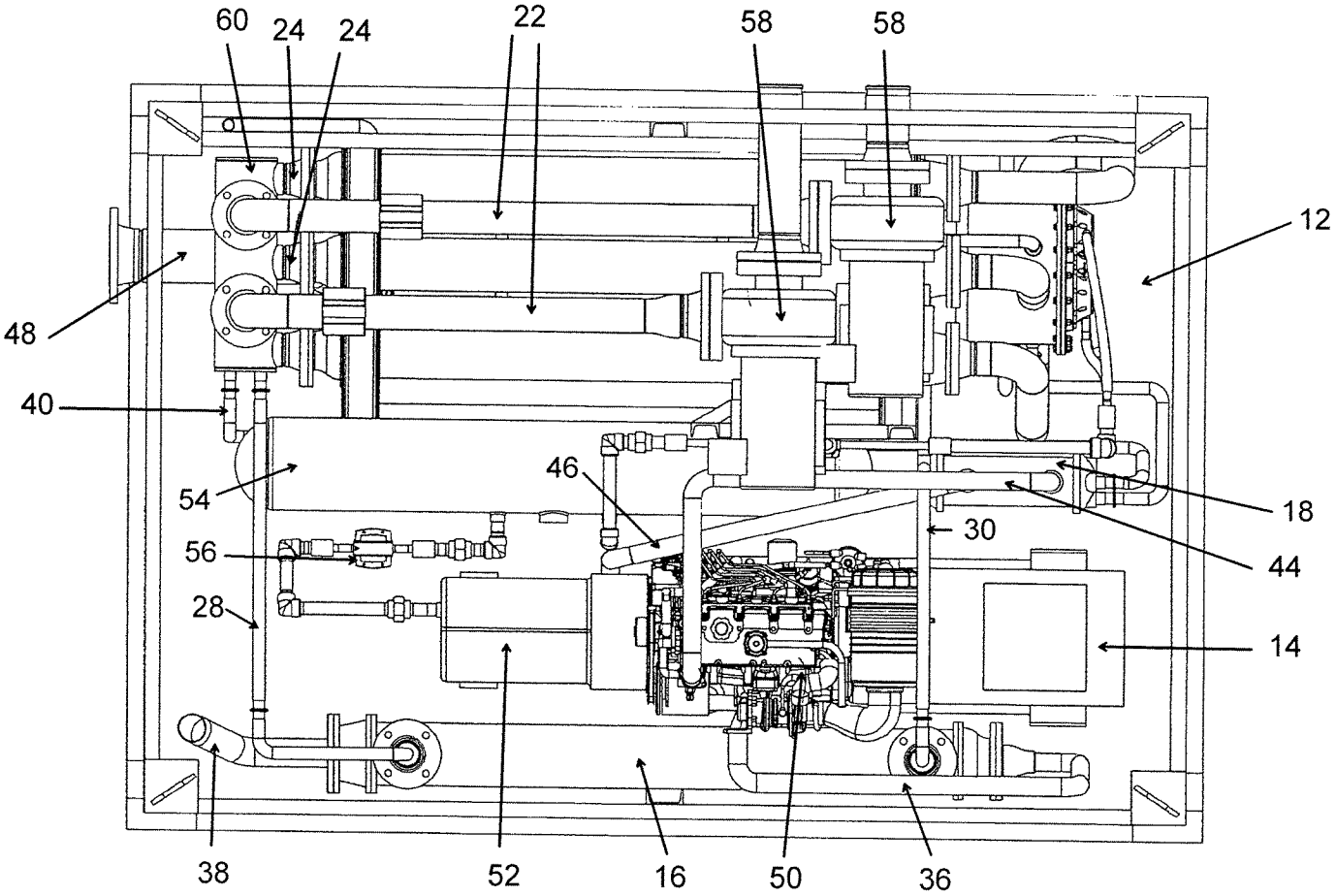
FIG. 7 is a top plan view of the heating assembly of FIG. 2.

FIGS. 2-7 are various views of a specific implementation of the heating assembly 10 shown schematically in FIG. 1. The components of the heating assembly of FIGS. 2-7 that are the same as the components in FIG. 1 are given the same respective reference numerals and therefore are not repeated here. As best shown in FIG. 7, the electrical generator 14 includes an engine 50 (e.g., a diesel, natural gas, or gasoline engine) that powers the generator. The generator 14 functions to provide electrical current to the plasma heat exchanger for generating plasma and to power other components of the assembly as needed. As can be appreciated, the use of an engine-driven generator allows the heating assembly 10 to be portable and/or used in applications where an electrical power supply is not readily available. If an electrical power supply is readily available, the generator 14 would not be needed. It also should be noted that any other source of electrical current can be used in place of the generator 14, such as fuel cells, batteries, etc.

Figure 2:
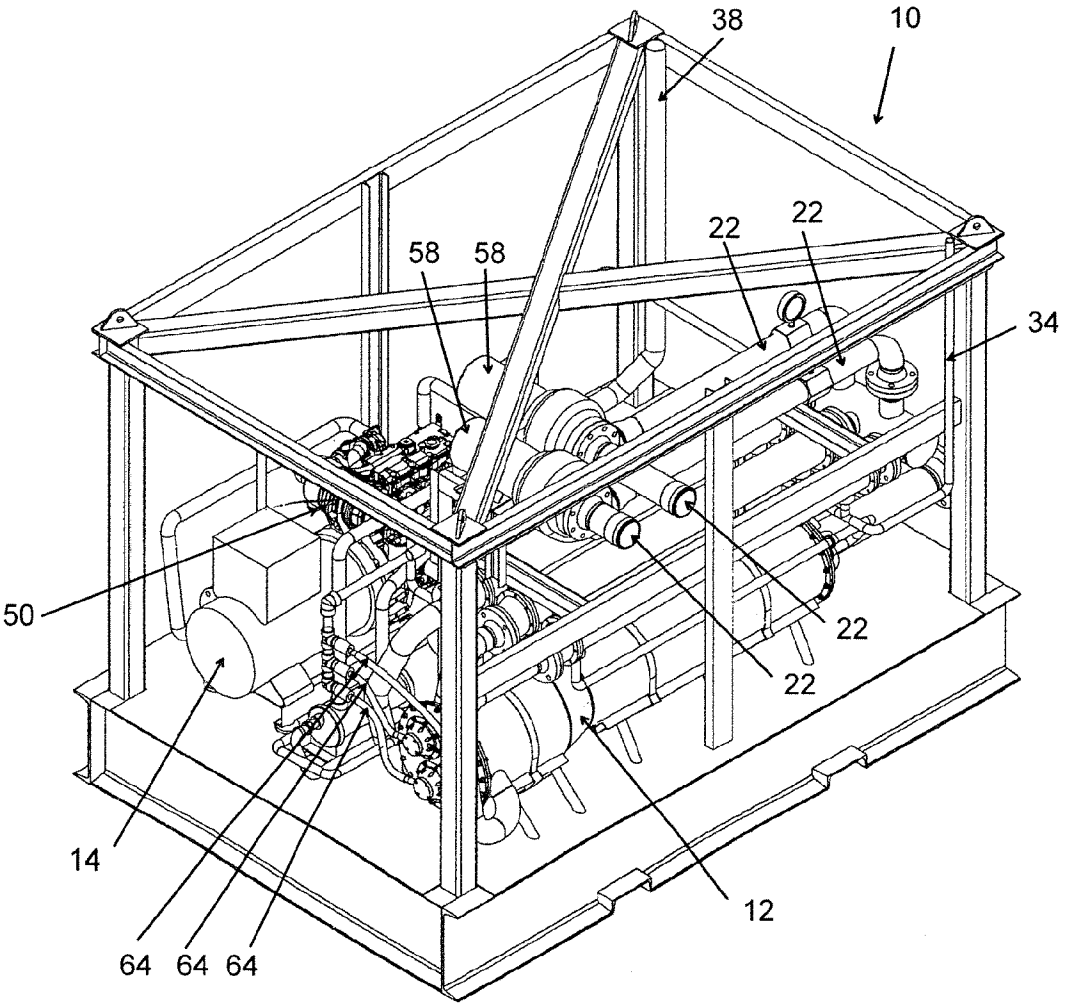
FIG. 2 is perspective view of a heating assembly for heating a fluid, according to one embodiment.
Figure 4:
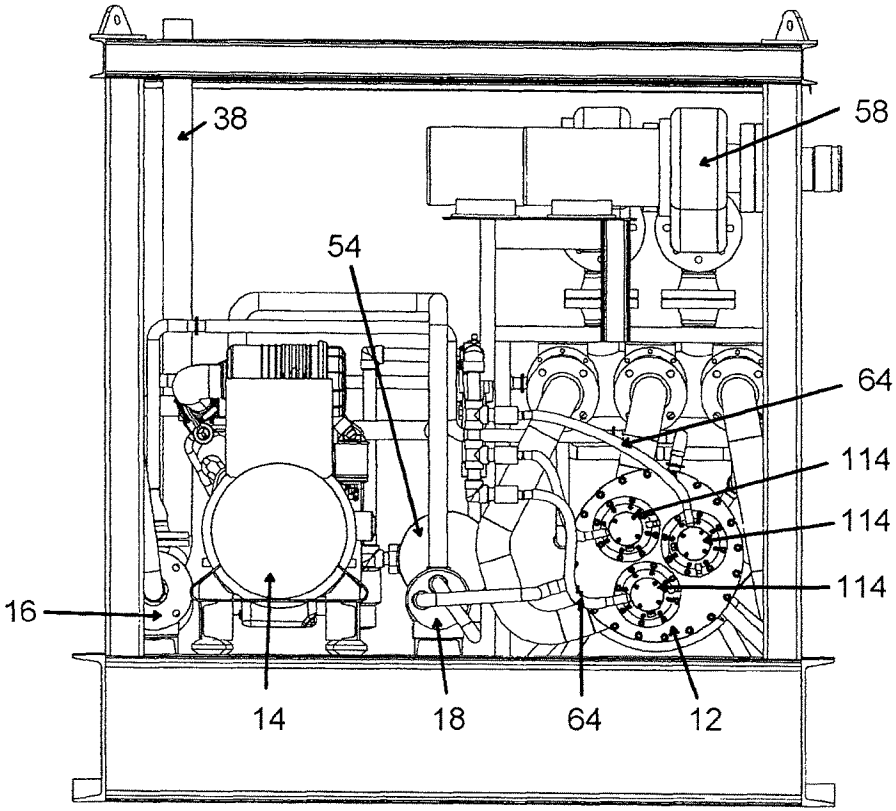
FIG. 4 is front elevation view of the heating assembly of FIG. 2.

The heating assembly 10 can also include an air compressor 52 (e.g., a rotary screw compressor or reciprocating compressor) that serves as a source of gas supplied to the plasma heat exchanger 12 for generating plasma. The compressed air from compressor 52 can flow through a conventional air/water separator 56, and into a compressed air storage tank 54. As best shown in FIGS. 2 and 4, compressed air in the tank 54 is supplied to the plasma heat exchanger via compressed air conduits 64, as further described below. The compressor 52 can be powered by electrical current from the generator 14 or another convenient power source. The air compressor 52 can also be replaced by any convenient source of a compressed gas that can be used in the generation of plasma. For example, the plasma heat exchanger can be supplied with an inert gas (e.g., helium, argon) from an inert gas source (e.g., a storage tank) if one is readily available.

In an alternative embodiment not shown in FIGS. 2-7, an air dryer can be fluidly connected to the separator 56 and the tank 54. In this alternative embodiment, compressed air from the compressor 52 can flow first through the separator 56, then through the dryer, which removes all or substantially all water vapor from the compressed air. After passing through both the separator 56 and the dryer, the compressed air can then flow into the tank 54. While many commercially available air dryers may be used, one that has been found to be suitable is the Ingersoll Rand HL400 Series desiccant air dryer.

Figure 3:
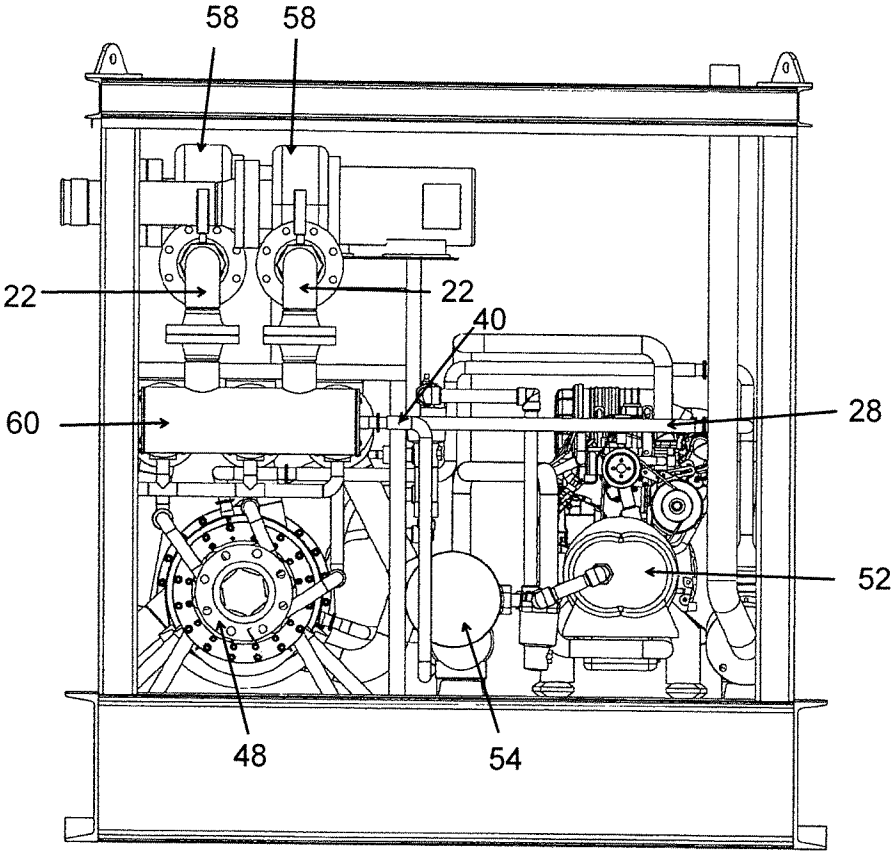
FIG. 3 is a rear elevation view of the heating assembly of FIG. 2.

The heating assembly 10 can also include water pumps 58 placed in the inlet water conduits 22. As best shown in FIGS. 3 and 7, pressurized water from pumps 58 flow through conduits 22, a manifold 60, where it is distributed to conduits 24, 28, and 40. In the embodiment illustrated in FIGS. 2-7, the components of the heating assembly 10 are arranged together on a frame. In an alternative embodiment, however, the components are not all arranged together in such a fashion and at least one of the components (e.g., the generator 14 or the air compressor 52) is provided in a location remote from the remainder of the assembly. In this alternative embodiment, wires, tubes, or other appropriate connecting elements are used to connect each of the remote components to the remainder of the assembly.

Figure 8:
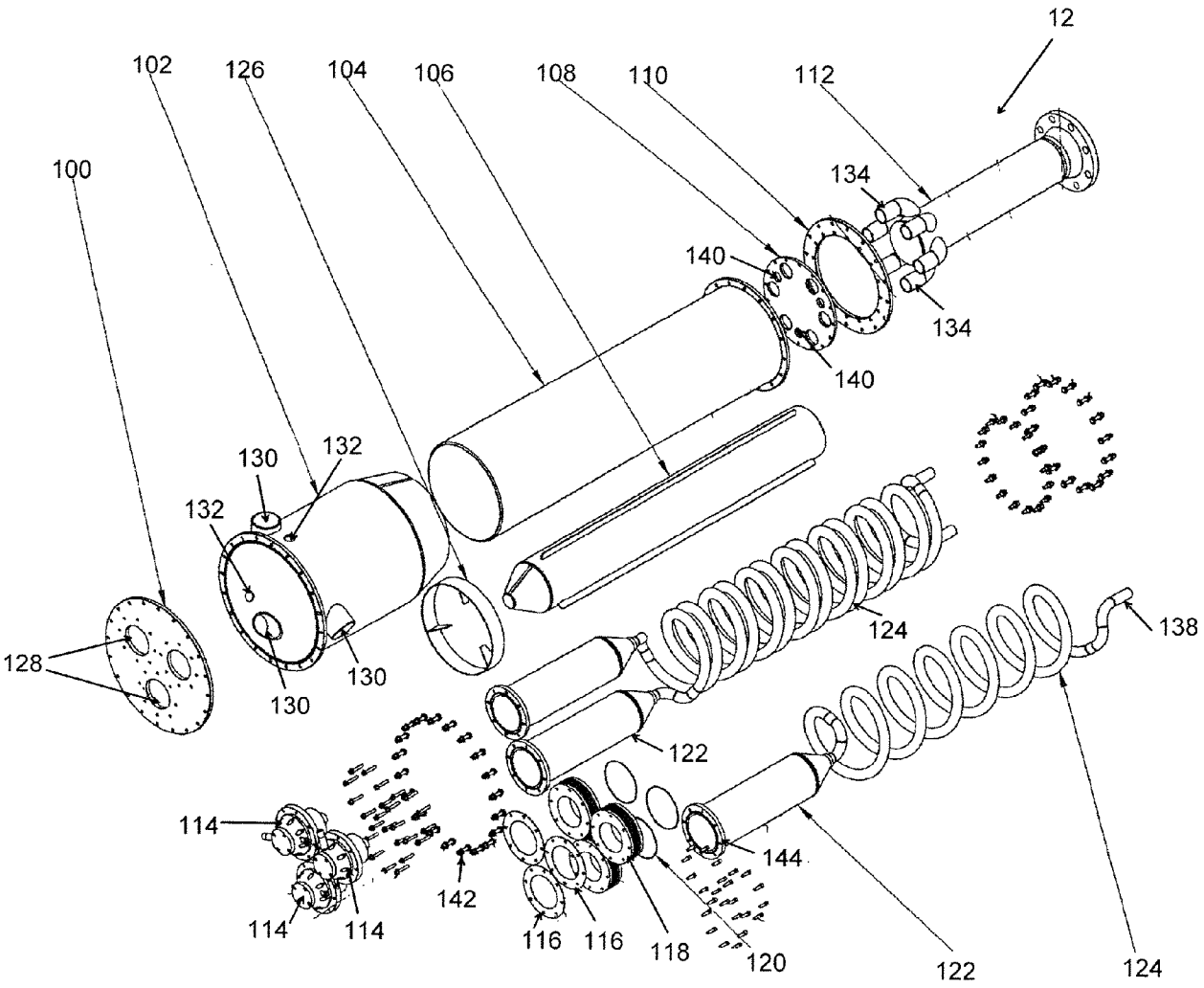
FIG. 8 is an exploded, perspective view of the plasma heat exchanger incorporated in the heating assembly of FIG. 2.

FIG. 8 shows an exploded view of the plasma heat exchanger 12. The plasma heat exchanger 12, in the illustrated embodiment, comprises a nozzle plate 100, a burner housing 102, a coil housing 104, a diverter 106, an exit plate 108, an exit flange 110, an outlet manifold 112, one or more plasma generators 114 (also referred to as plasma torches or plasma nozzle assemblies), one or more gaskets 116, one or more heat sinks 118, one or more seals 120, one or more burn chambers 122 disposed in the burner housing 102, one or more coils 124 disposed in the coil housing, and a support ring 126 that supports the diverter 106 within the coil housing 104.

Figure 9:
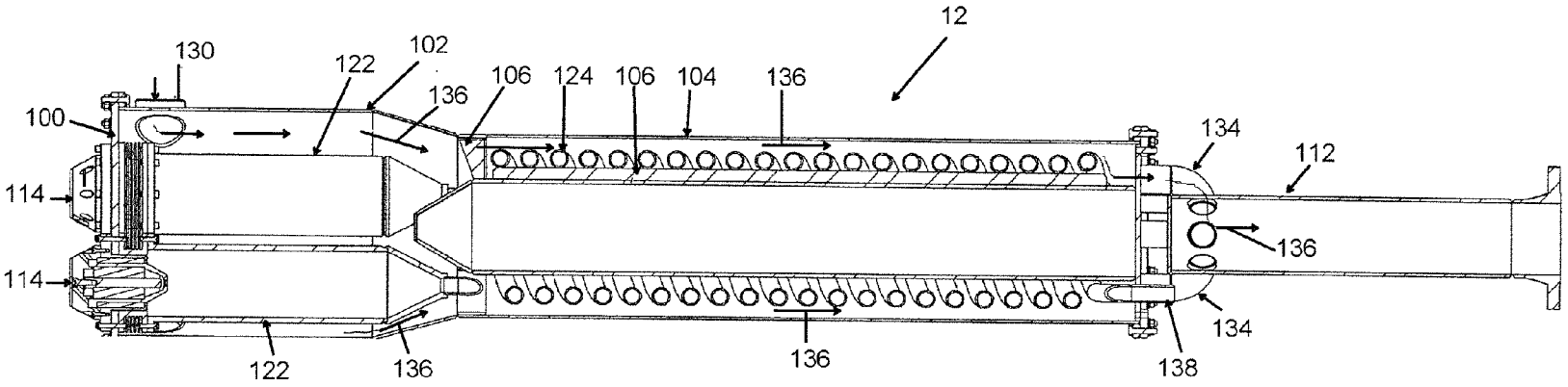
FIG. 9 is a cross-sectional view of the plasma heat exchanger of FIG. 8.
Figure 9A:
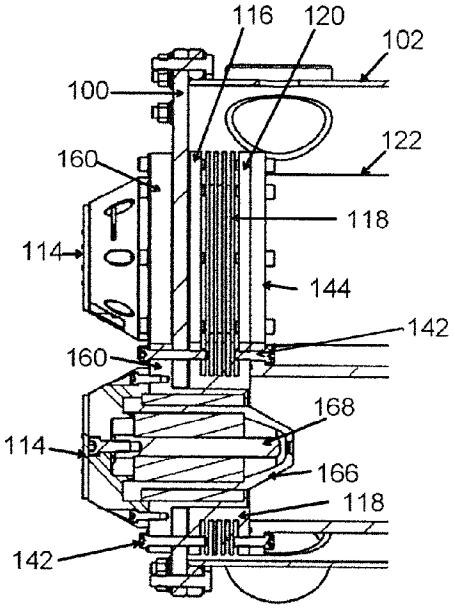
FIG. 9A is an enlarged view of the forward end portion of the heat exchanger section shown in FIG. 9.

The nozzle plate 100 includes one or more apertures 128, each of which is sized to receive and support a respective plasma generator 114. As best shown in FIGS. 9 and 9A, each plasma generator 114 extends through a corresponding aperture 128 and partially into a respective burn chamber 122. The inflow end of each burn chamber 122 (the end closest to the nozzle plate 100) is connected to the nozzle plate 100 with a heat sink 118. A gasket 116 (or equivalent sealing element) can be positioned between each heat sink 118 and the inside surface of the nozzle plate 100. Another gasket 120 (or equivalent sealing element) can be positioned between each heat sink 118 and an end flange 144 of an adjacent burn chamber 122. Each plasma generator 114 can be secured to the nozzle plate 100 and a burn chamber 122 by a plurality of bolts 142 that extend through the plasma generator 114, the nozzle plate 100, a respective gasket 116, a respective heat sink 118, and an end flange 144 of the respective burn chamber 122.

Figure 5:
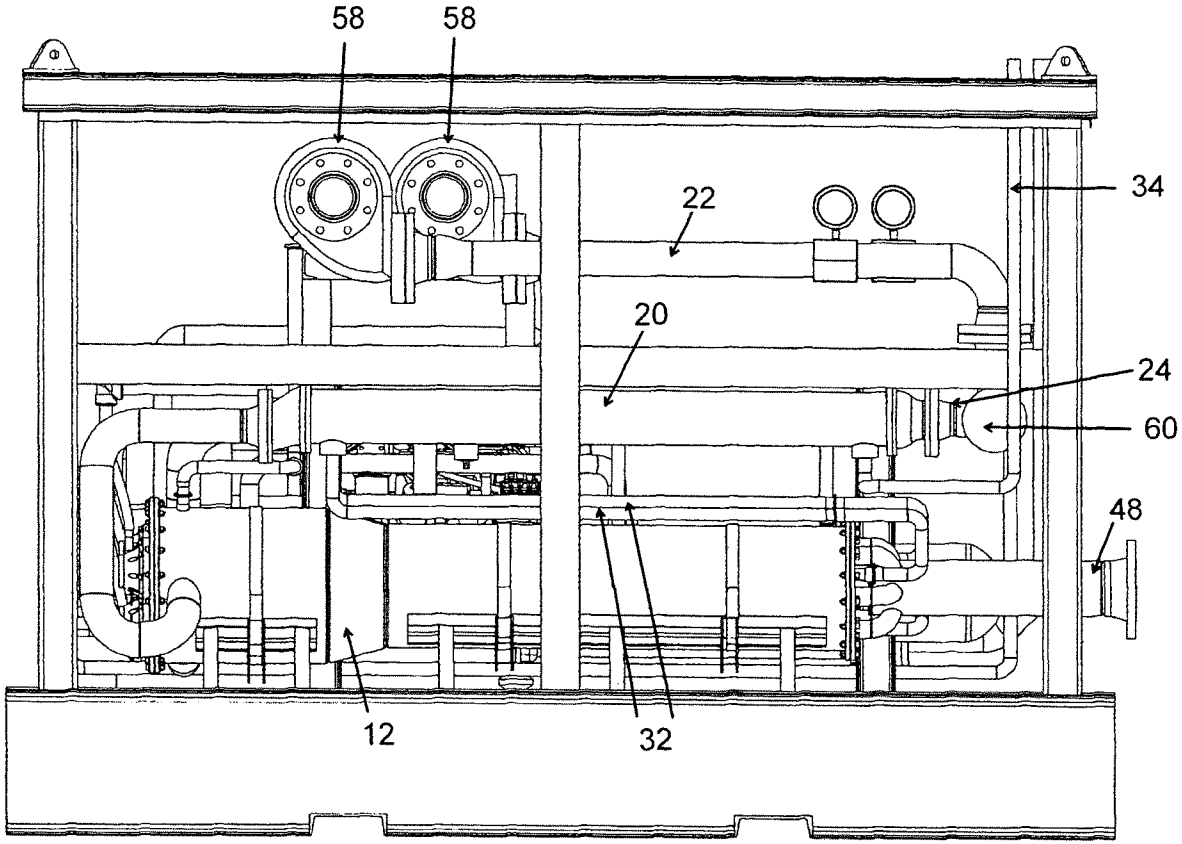
FIG. 5 is a right side elevation view of the heating assembly of FIG. 2.
Figure 6:
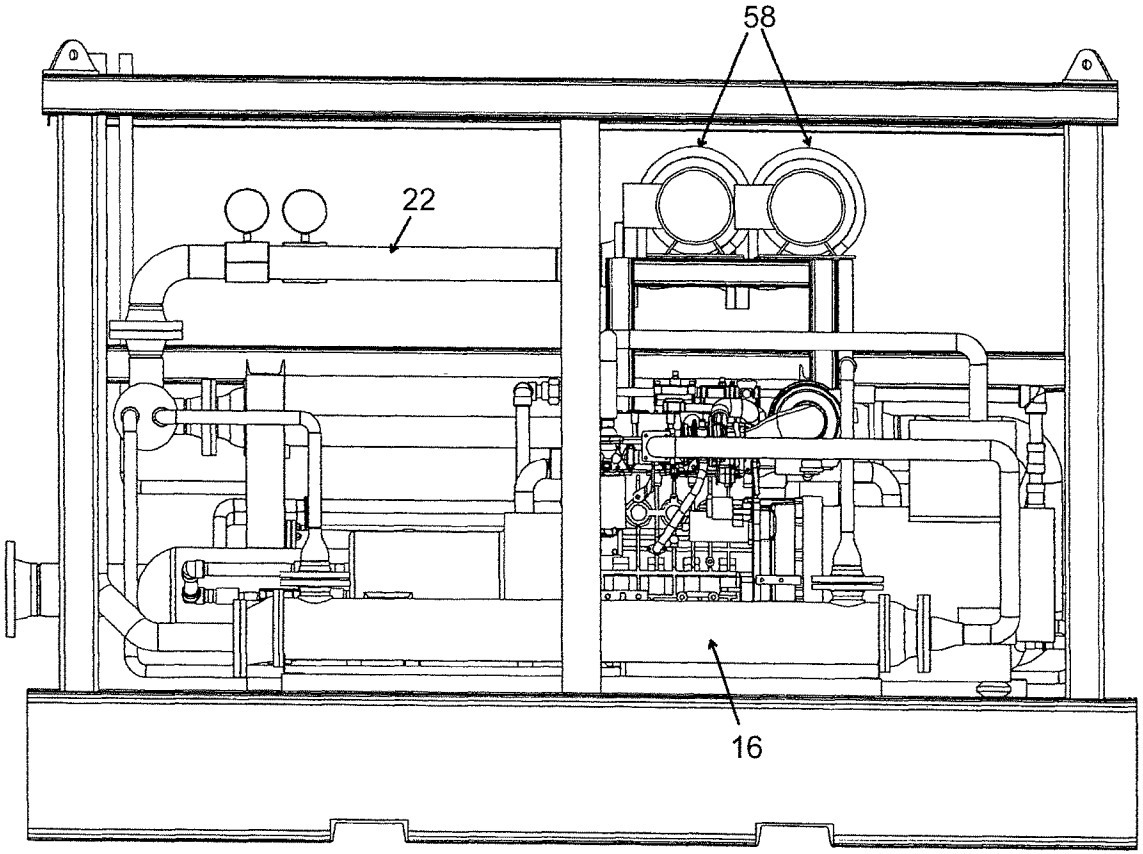
FIG. 6 is a left side elevation view of the heating assembly of FIG. 2.

Each plasma generator 114 receives compressed air from the compressor 52 (or compressed gas from another source) and electrical current from the generator 14 (or another current source) to generate plasma, which is directed into respective burn chambers 122. Each burn chamber 122 is in fluid communication with a respective coil 124 that receives plasma and/or heated exhaust gases from the burn chamber. Each coil 124 can have an end portion 138 that extends through a corresponding aperture 140 in end plate 108 and is fluidly connected to a respective conduit 32 (FIG. 5) that directs heated exhaust to flow into respective plasma exhaust heat exchangers 20 (FIG. 5). Each burn chamber 122 and respective coil 124 collectively form a conduit that receives plasma and/or hot exhaust gases used to heat a liquid in the plasma heat exchanger 12. In an alternative embodiment, the coil 124 or a portion thereof can be a straight, non-coiled conduit.

The burner housing 102 includes one or more inlet openings 130 (three in the illustrated embodiment) spaced in the circumferential direction around the outer surface of the housing. Each opening 130 is fluidly connected to a respective conduit 26 (FIG. 1). Thus, the fluid to be heated (e.g., water) flows through conduits 26 and into the housing 102 via openings 130. The housing 102 can further include secondary openings 132 that receive fluid to be heated from conduits 30 and 42. Fluid entering the heat exchanger via openings 130, 132 flows through the burner housing and over the burner chambers 122, and then upon entering the coil housing 104, the diverter 106 causes the fluid to flow radially toward the inner surface of the coil housing so as to flow over the coils 124 (as indicated by arrows 136). At the rear end of the coil housing, the fluid flows outwardly through outlet conduits 134 and into outlet manifold 112.

Figure 11:
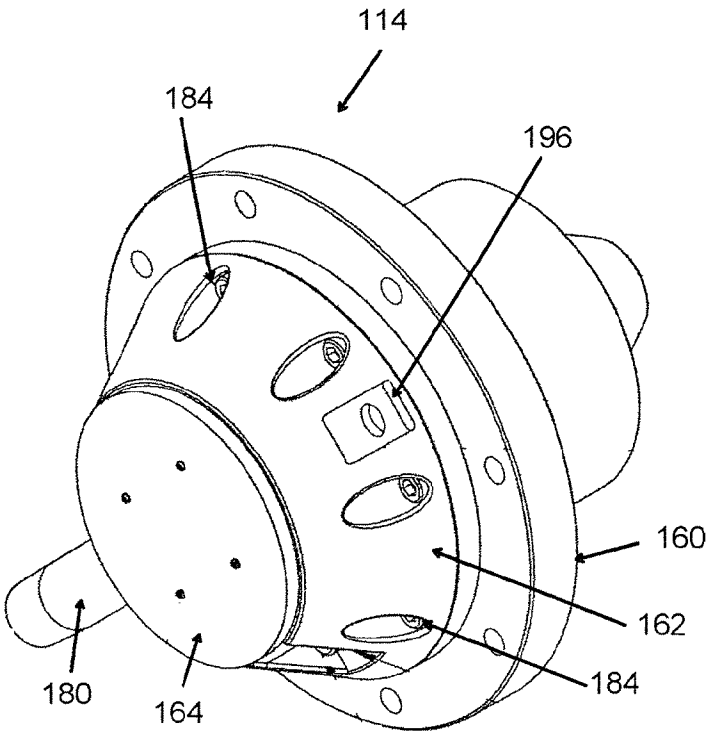
FIG. 11 is a perspective view of the plasma generator shown in FIG. 10.
Figure 10:
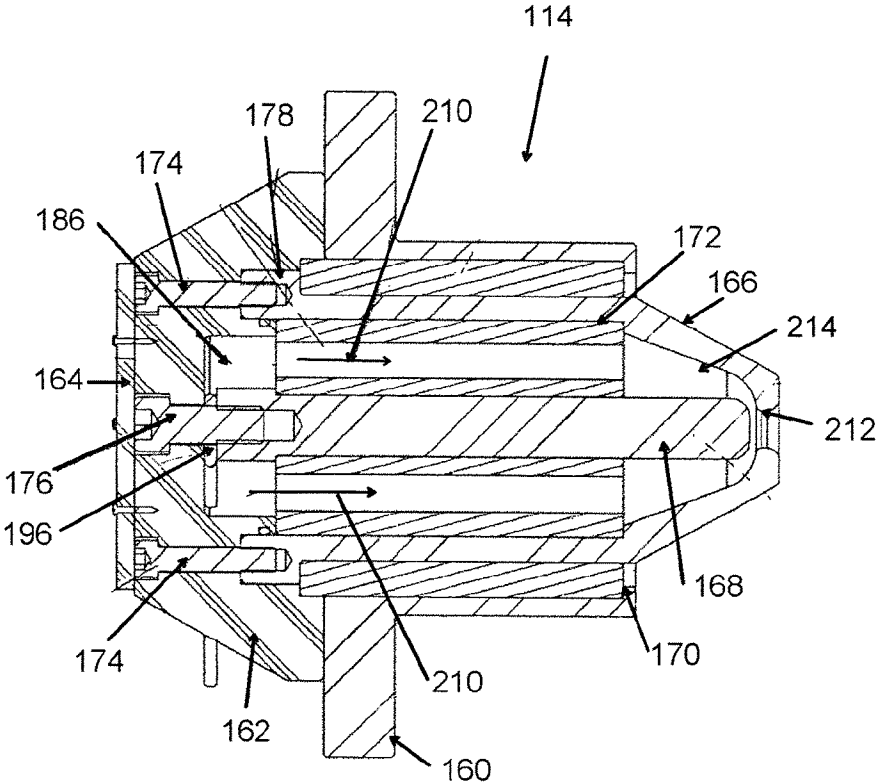
FIG. 10 is a cross-sectional view of a plasma generator, according to one embodiment.

Referring to FIGS. 10 and 11, the plasma generator 114 will now be described in greater detail. The plasma generator 114 in the illustrated embodiment comprises a nozzle housing 160, an air injection cap 162, an end plate 164, a nozzle 166 disposed partially in the housing 160, an electrode 168 centrally positioned within the nozzle 166, an outer insulator 170 disposed between the housing 160 and the nozzle 166, and an inner insulator 172 disposed between the electrode 168 and the nozzle 166. The electrode 168 serves as the anode of the plasma generator and the nozzle 166 serves as the cathode of the plasma generator. In use, the two sides of an electrical potential source are electrically connected to these components to establish an electric arc.

Figure 13:
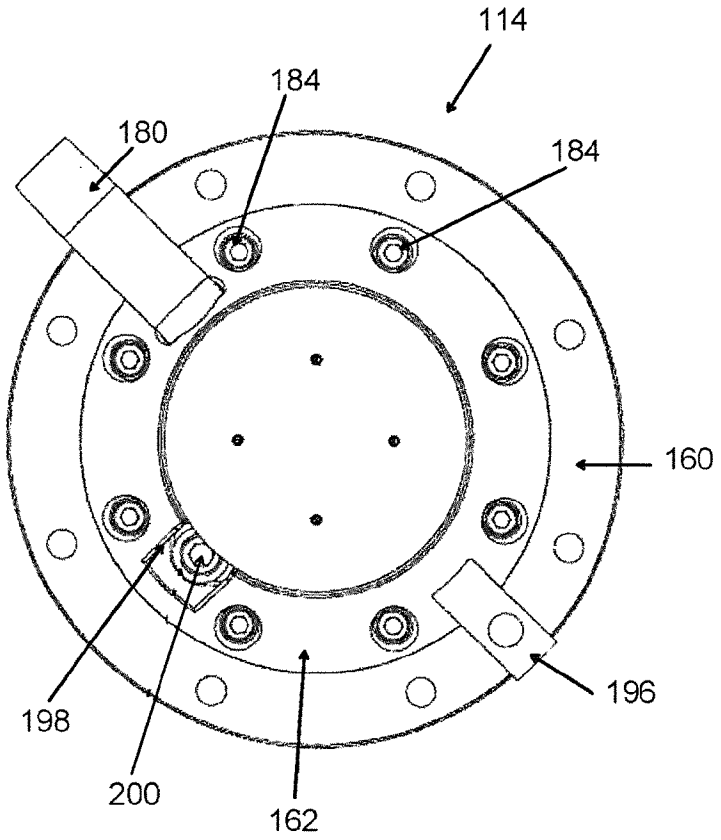
FIG. 13 is a front elevation view of the plasma generator shown in FIG. 10.

The air injection cap 162 can be secured to the nozzle 166 by a plurality of bolts 174 that extend through corresponding openings in the cap 162 and are tightened into corresponding openings in an end flange 178 of the nozzle 166. The electrode 168 can be secured to air injection cap 162 by a central bolt 176 that extends through an opening in the cap 162 and is tightened in a central opening in the electrode 168. As best shown in FIGS. 11 and 13, the air injection cap 162 can be secured to the nozzle housing 160 by a plurality of bolts 184 that extend through corresponding openings in the cap 162 and are tightened in corresponding openings in the nozzle housing 160.

Figure 14:
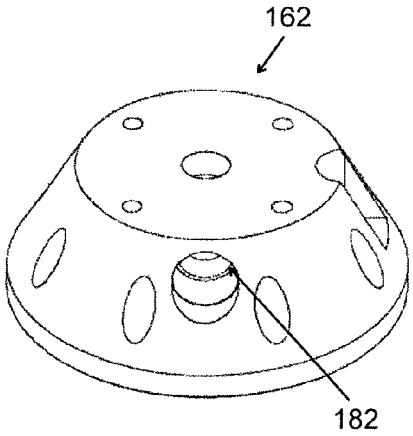
FIG. 14 is an enlarged, perspective view of the air injection cap of the plasma generator shown in FIG. 10.
Figure 15:
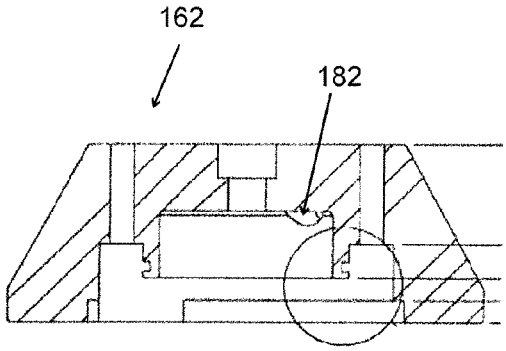
FIG. 15 is a cross-sectional view of the air injection cap shown in FIG. 14.
Figure 16:
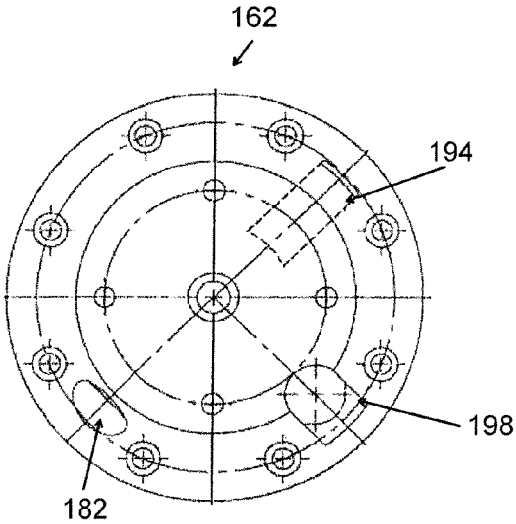
FIG. 16 is a front elevation view of the air injection cap shown in FIG. 14.

The air injection cap 162 includes an inlet conduit 180 that is fluidly connected to a source of compressed gas (e.g., compressed air). In the illustrated embodiment, for example, the inlet conduit 180 is connected to a compressed air line 64 that supplies compressed air from tank 54 to the plasma generator 114. As best shown in FIGS. 14-16, the air injection cap 162 includes a side opening 182 that extends from the outer surface of the cap to an internal space 186 of the cap. The inlet conduit 180 extends into the side opening 182 so that compressed gas flows through the opening 182 and into the internal space 186 of the air injection cap 162.

Figure 12:
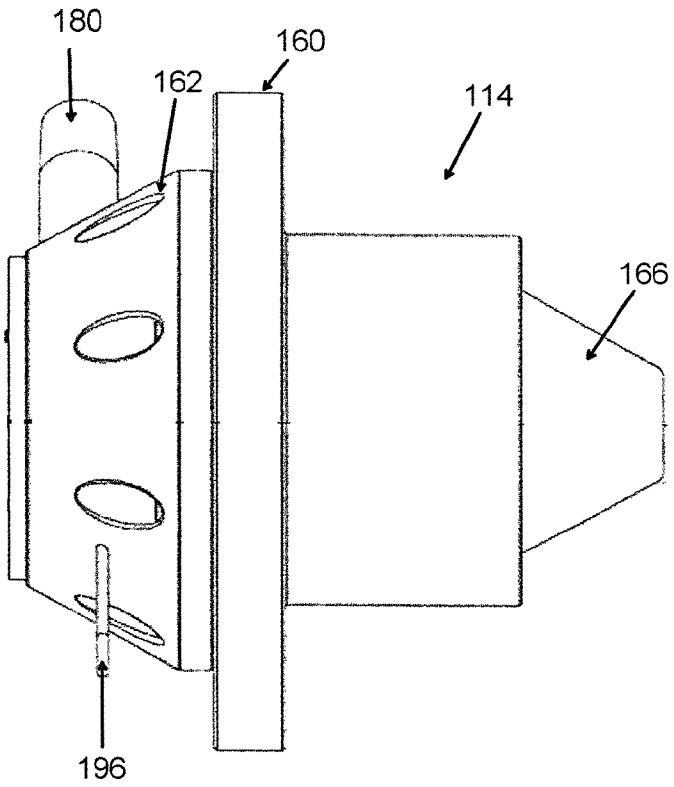
FIG. 12 is a side elevation view of the plasma generator shown in FIG. 10.
Figure 23:
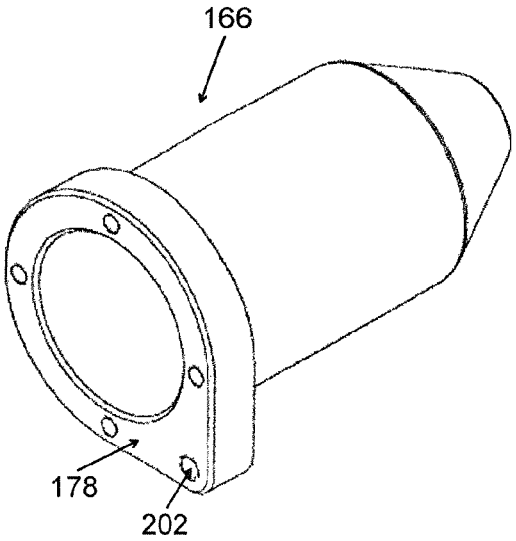
FIG. 23 is a perspective view of the nozzle of the plasma generator shown in FIG. 10.
Figure 24:
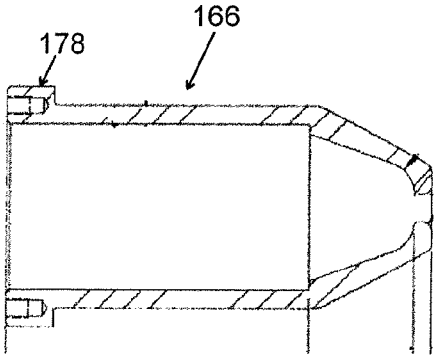
FIG. 24 is a cross-sectional view of the nozzle shown in FIG. 23.

The air injection cap 162 can further include a slot 194 that extends all the way through the side wall of the air injection cap. A conductor bar 196 (FIGS. 12 and 13) is inserted into and through the slot 194 so as to physically and electrically contact the end surface of the electrode 168 (FIG. 10). The air injection cap 162 can also be formed with a recessed portion 198 that receives the head of a bolt 200 (FIG. 13). The bolt 200 extends through the air injection cap 162 and is tightened into a corresponding opening 202 (FIG. 23) in the flange 178 of the nozzle 166. A first cable or other electrical conductor (not shown) electrically connected to the positive side of the generator 14 is connected to the conductor bar 196 and a second cable or other electrical conductor (not shown) electrically connected to the negative side of the generator 14 is connected to the bolt 200. In this manner, the electrode 168 can be placed in electrical contact with the positive side of the generator and the nozzle 166 can be placed in electrical contact with the negative side of the generator.

Figure 17:
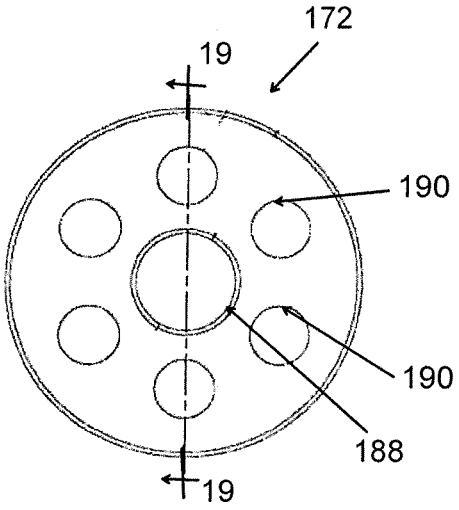
FIG. 17 is a front elevation view of the inner insulator of the plasma generator shown in FIG. 10.
Figure 18:
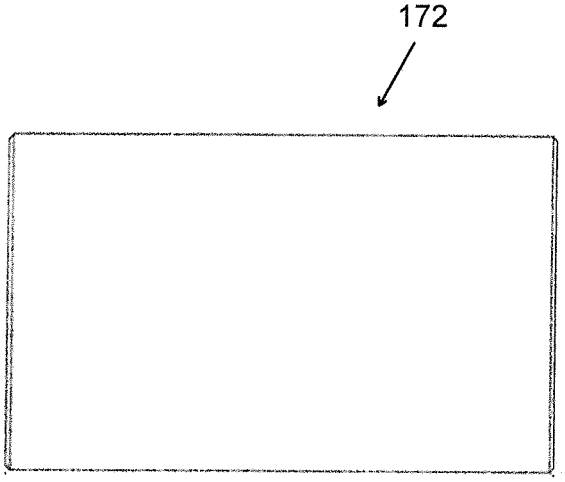
FIG. 18 is a side elevation view of the inner insulator shown in FIG. 17.
Figure 19:
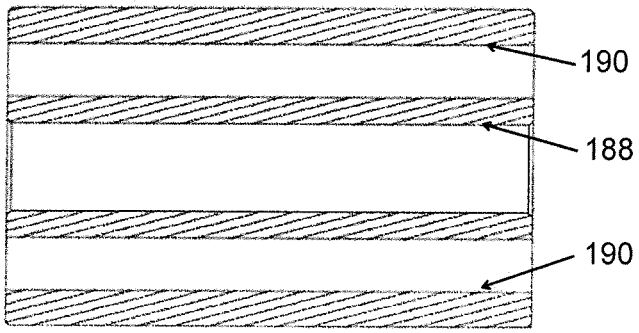
FIG. 19 is a cross-sectional view of the inner insulator taken along line 19-19 of FIG. 17.
Figure 20:
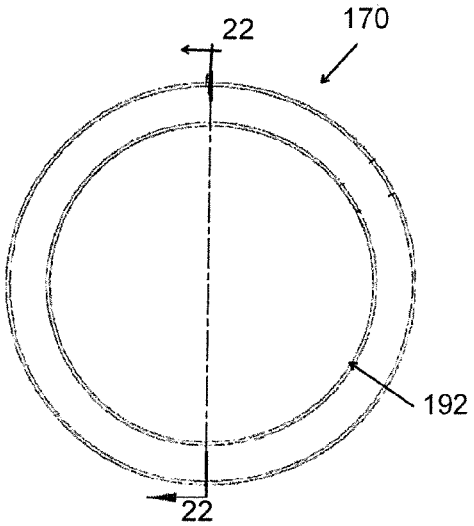
FIG. 20 is a front elevation view of the outer insulator of the plasma generator shown in FIG. 10.
Figure 21:
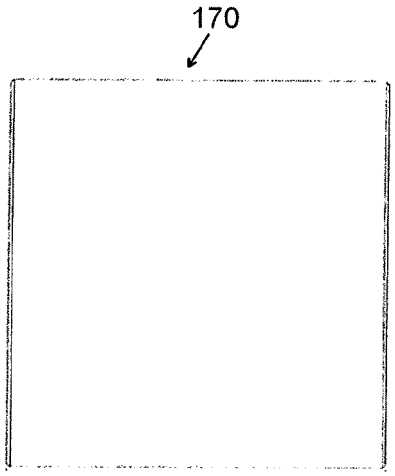
FIG. 21 is a side elevation view of the outer insulator shown in FIG. 20.
Figure 22:
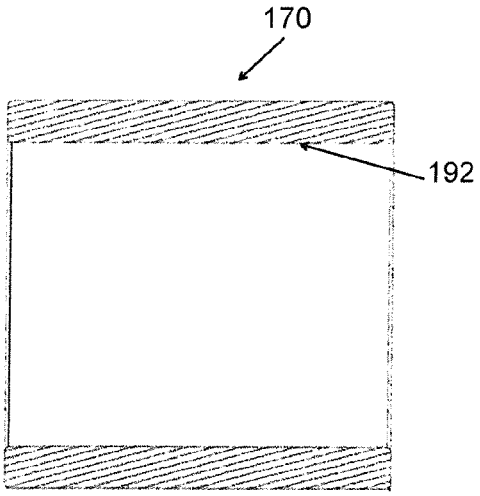
FIG. 22 is a cross-sectional view of the outer insulator taken along line 22-22 of FIG. 20.

As best shown in FIGS. 17-19, the inner insulator 172 comprises a central opening 188 that receives the electrode 168 and a plurality of longitudinally extending, outer openings 190 that are angularly spaced about the central opening 188. As shown in FIG. 10, the openings 190 are aligned with internal space 186 of the air injection cap 162 and allow compressed gas to flow through the insulator 172. As best shown in FIGS. 20-22, the outer insulator 170 comprises a central opening 192 sized to fit around the nozzle 166. The insulators 170, 172 help insulate the nozzle housing and adjacent components of the heat exchanger 12 from the heat generated inside the plasma generator 114. The insulators 170, 172 can be made of alumina or any of various other suitable materials. In one example, the insulators are made of 99% alumina.

Figure 26:
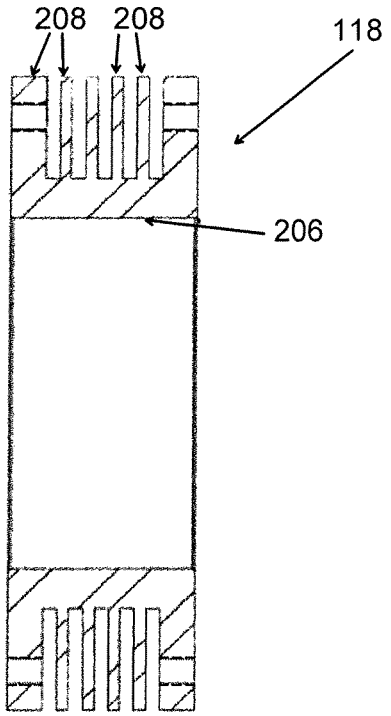
FIG. 26 is a cross-sectional view of the heat sink taken along line 26-26 of FIG. 25.
Figure 25:
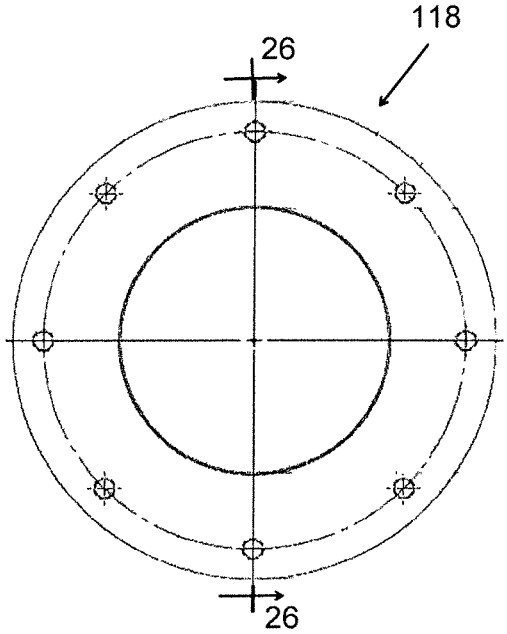
FIG. 25 is a front elevation view of one of the heat sinks of the plasma heat exchanger shown in FIG. 8.
Figure 27:
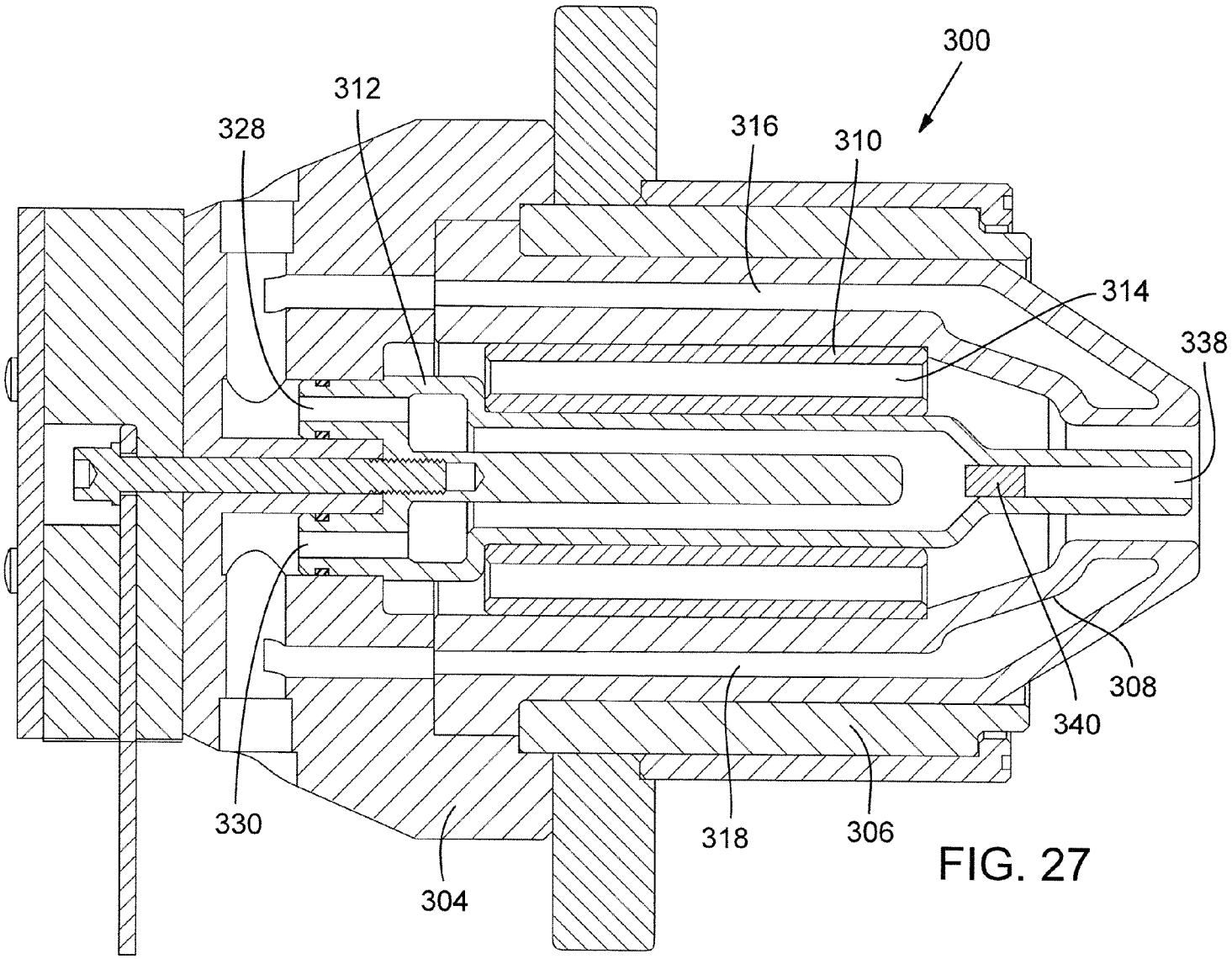
FIGS. 27 and 28 are cross-sectional views of an alternative plasma generator, according to another embodiment.
Figure 28:
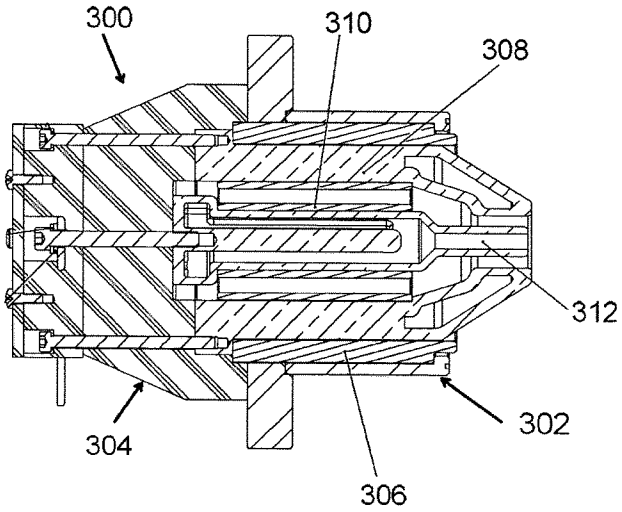

As best shown in FIG. 9A, the nozzle generators 114 are mounted to the nozzle plate 100 such that the nozzle housing 160 and the nozzle 166 extend partially into the burner housing 102. A heat sink 118 is co-axially mounted around the portion of each nozzle housing extending into the burner housing. As best shown in FIGS. 25 and 26, the heat sink 118 can comprise an annular ring shaped structure comprising a central opening 206 adapted to receive a nozzle housing 160 and a plurality of axial spaced, annular fins 208. The heat sinks 118 assist is transferring heat from the plasma generators 114 to the surrounding fluid. Thus, the heat sinks 118 help promote heating of the fluid in the burner housing 102 and help cool the plasma generators 114 to keep them below the desired operating temperature.

In one specific embodiment, the various components of the heat exchanger 12 and the nozzle generator 114 are made of the following materials. The air injection cap 162 and the end plate 164 are made of polytetrafluoroethylene (PTFE). The nozzle 166 and the electrode 168 are made of a copper-tungsten alloy. The inner and outer insulators 172, 170, respectively, are made of 99% alumina. The housing 160 is made of 316L stainless steel. The conductor bar 194 is made of copper. The burner housing 102, the coil housing 104, the diverter 106, the burn chambers 122, the coils 124, the outlet pipe 112, and the heat sinks 118 are made of stainless steel, such as 316L or 310L stainless steel.

Referring to FIGS. 27-35, an alternative plasma generator 300 will now be described. Multiple plasma generators 300 can be used in place of the plasma generators 114 within the heat exchanger 12. The plasma generator 300 in the illustrated embodiment comprises a housing 302 and an air and water injection cap 304. The housing 302 houses several nested cylindrical components including an outer insulator 306 in contact with the inner surface of the housing 302, a cathode 308 in contact with the inner surface of the outer insulator 306, an inner insulator 310 in contact with the inner surface of a cathode 308, and an anode 312 in contact with the inner surface of the inner insulator 310. An electrical potential difference is established between the cathode 308 and the anode 312 when connected to a source of electricity, and thus an electric arc can be generated in the air passing between them.

Figure 30:
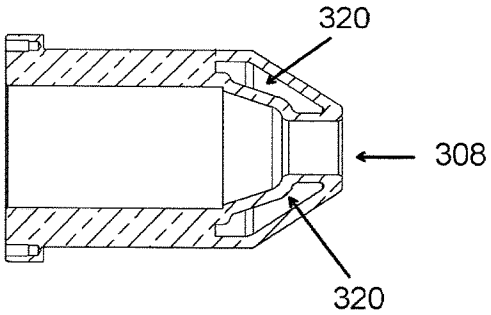
FIGS. 29 and 30 are cross-sectional views of the cathode of the plasma generator shown in FIGS. 27 and 28.
Figure 29:
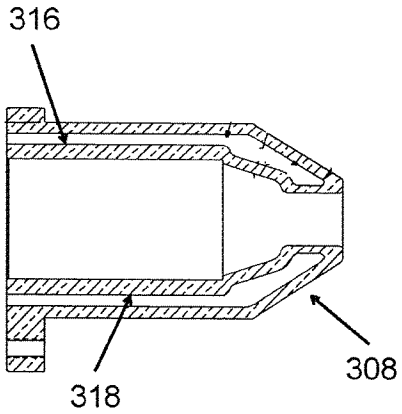
Figure 31:
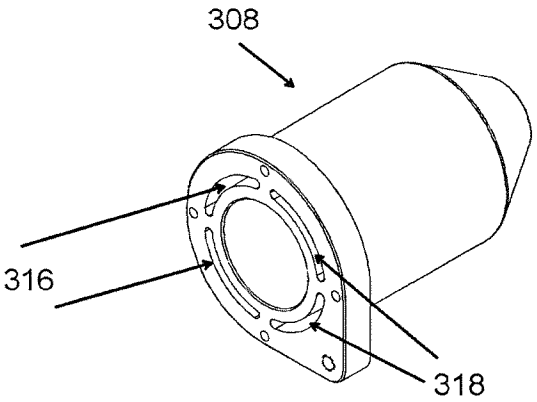
FIG. 31 is a perspective view of the cathode of the plasma generator shown in FIGS. 27 and 28.
Figure 35:
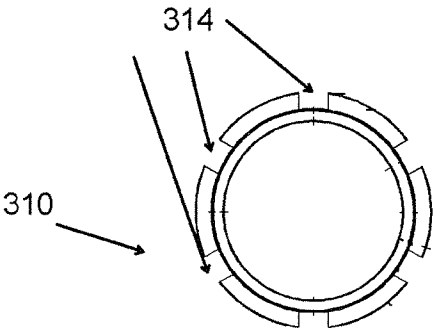
FIG. 35 is a cross sectional view of the inner insulator of the plasma generator shown in FIGS. 27 and 28.

The outer insulator 306 is generally cylindrically shaped and comprises an insulating material. As best seen in FIGS. 29-31, the cathode 308 is generally cylindrically shaped and includes a system of ducts or channels to allow a coolant fluid to flow through its structure. In the illustrated embodiment, the cathode 308 includes four ducts or channels, each projecting axially through the interior of the cathode 308. As illustrated, two inflow ducts 316 carry water (or another coolant fluid) into the cathode from a water source, while two outflow ducts 318 receive water from the inflow ducts 316 via channels 320 and carry the water out of the cathode 308. Each channel 320 extends between and fluidly connects an inflow duct 316 to a respective outflow duct 318. As best shown in FIG. 35, the inner insulator 310 is generally cylindrically shaped and, as illustrated, includes six air channels 314 for carrying air through the plasma generator 300.

Figure 33:
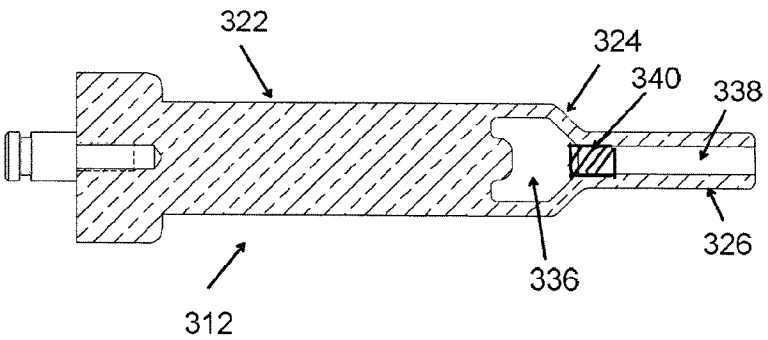
FIGS. 32 and 33 are cross-sectional views of one embodiment of the anode of the plasma generator shown in FIGS. 27 and 28.
Figure 32:
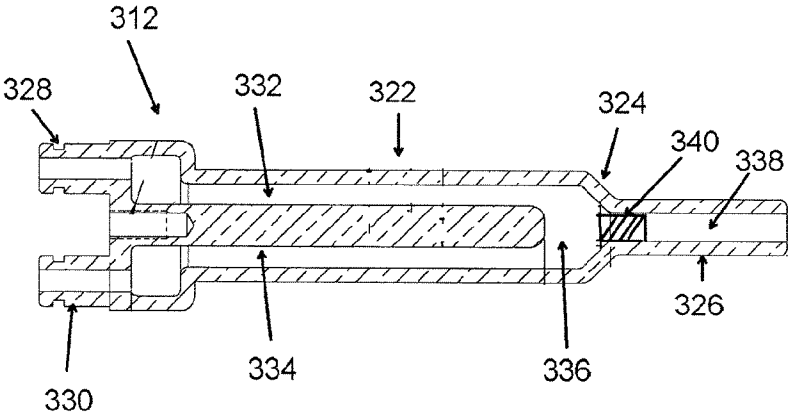
Figure 34:
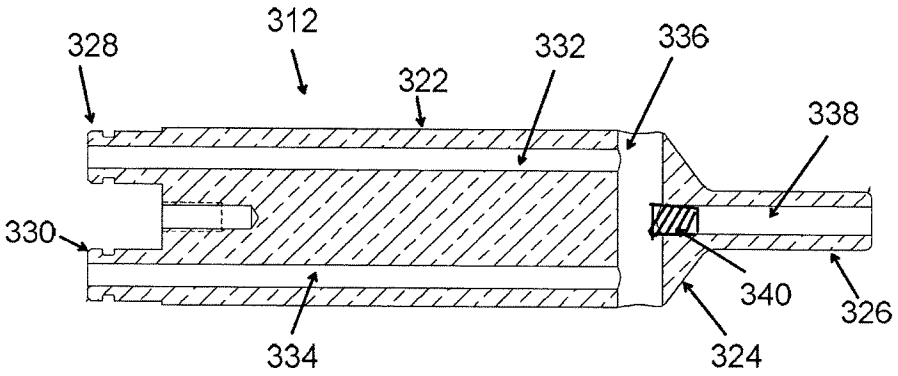
FIG. 34 is a cross-sectional view of another embodiment of the anode of the plasma generator shown in FIGS. 27 and 28.

As best illustrated in FIGS. 32-34, the anode 312 is generally cylindrically shaped and includes a larger diameter cylindrical portion 322, a transition portion 324, a smaller diameter cylindrical portion 326, a water inlet extension 328 and a water outlet extension 330. The anode 312 further comprises an inlet duct or channel 332 and an outlet duct or channel 334, each extending through the larger cylindrical portion, one transfer duct or channel 336 extending through the transition portion 324, and one distal channel 338 in the smaller cylindrical portion 326. The water inlet extension 328, the inlet duct 332, the transfer duct 336, the outlet duct 334, and the water outlet extension 330 are in fluid communication such that a pressurized fluid introduced into the water inlet extension 328 will flow through the inlet duct 332 along the length of the larger diameter portion 322, through the transfer duct 336, back through the outlet duct 334 along the length of the larger diameter portion 322, and exit through the water outlet extension 330. The anode 312 can be fabricated either by machining from a solid piece of material (FIG. 34), or by casting (FIGS. 32-33). A cylindrical slug 340 may be positioned in the distal channel 338. The slug 340 can comprise, as one specific example, halfnium coated in silver, and may aid in transferring heat energy from plasma generation from the smaller cylindrical portion 326 to the water or other coolant fluid carried through the transfer duct 336. As shown, the slug 340 can be positioned such that an end portion of the slug extends into the transfer duct.

In the illustrated configuration, pressurized water can be provided to and withdrawn from the various ducts in the anode and the cathode via conduits through the injection cap 304. The provision of flowing water helps insulate and protects against overheating of the anode 312 and cathode 308, which carry electric current for the generation of plasma. Also in this configuration, air for generating plasma is provided via conduits through the injection cap 304 to the air channels 314, which carry the air through the plasma generator.

In one specific embodiment, the components of the plasma generator 300 are made of the following materials. The injection cap 304 is made of PTFE. The cathode 308 and anode 312 are made of a copper-chromium alloy. The inner insulator 310 and the outer insulator 306 are made of 99% alumina, and the housing 302 is made of stainless steel such as grade 303 stainless steel.

Referring again to FIG. 10, to generate plasma, an electrical potential difference is established between the electrode 168 and the nozzle 166, which causes an electric arc to be established across the radial gap 214 between the end portion of the electrode 168 and the surrounding portion of the nozzle 166. Compressed air (e.g., compressed air at 20 psig) supplied to the air injection cap 162 flows through the nozzle 166 as indicated by arrows 210. As the compressed air crosses the electric arc, the air is ionized, creating plasma, or a plasma arc, which is discharged outwardly through the outlet opening 212 of the nozzle and into the respective burner chamber 122. The fluid to be heated in the heat exchanger 12 (e.g., water) flows over the burner chambers 122 and the coils 124 and therefore is heated by the heat of plasma and exhaust gases in the burner chambers and the coils.

The frequency of the power supply to the plasma generators can be adjusted to vary the electric arc between the electrode 168 and the nozzle 166. In particular, increasing the frequency above 60 Hz, to about 80-85 Hz or greater, can increase the frequency of sparks across the gap 214 to form a substantially annular electric arc extending between the electrode 168 and the nozzle 166, which promotes the generation of plasma from the air crossing the electric arc. The frequency of the power supply can be increased in some embodiments to at least 100 kHz, and in some embodiments up to 50 GHz.

The assembly 10 can further include a controller to control the operation of the various components of the assembly, including the generator 14, the air compressor 52, the pumps 58, and the plasma generators 114. The controller can be programmed (such as by user input) to set various operating parameters, such as the voltage, current and frequency of power supplied to each plasma generator and the operating sequence of each plasma generator. For example, each plasma generator 114 can be cycled on and off in a predetermined sequence with the other plasma generators to avoid overheating of the generators. In a specific implementation, for example, only one plasma generator is cycled on while the other two are cycled off. Initially, each plasma generator is cycled on for a period of about 5-7 seconds and then for a period of about 3 seconds for each subsequent cycle. It should be noted that the operating parameters of the generators 114 (including the operating sequence and frequency) can be varied depending on the specific application.

In a specific application, the heating assembly 10 is used to heat a cleaning fluid for treating a well bore or pipeline used in the transfer of hydrocarbon fluids, such as oil and gas. In the transfer and production of hydrocarbon fluids, well bores, pipelines and other conduits become clogged and/or fouled from accumulation of various compounds. A known technique for cleaning well bores and pipelines involves heating a solution and injecting the solution into the well bore and/or pipeline. A known heating system used for this purpose utilizes friction heating to heat about 4,800 gallons of water per hour to about 250 degrees F. The assembly 10 of the present disclosure can be used to heat about 18,000 gallons of water per hour from ambient (about 68 degrees F.) to about 290 degrees F. The heating assembly 10 can also be used to heat any of various other fluids, such as diesel fuel and kerosene, for cleaning well bores and pipelines. The heated fluid can also be used for fracking in which the fluid is injected into a well bore under pressure to create fractures in underground rock formations, such as shale rock and coal beds.

In another application, the heating assembly can be used to heat nitrogen for use in fracking. In such an application, liquid nitrogen stored in a tank (which can be on or adjacent the heating assembly) is supplied to an expansion chamber, which allows the nitrogen to expand into a gas. From the expansion chamber, the nitrogen flows into the plasma heat exchanger and is heated to at least about 85 degrees F. The heated nitrogen exiting the heat exchanger can be pressurized and injected into a well bore for fracking, as known in the art. In another embodiment, the nitrogen can be fed into the plasma generators 114 (instead of the compressed air) to create high temperature plasma from the nitrogen. The nitrogen cools to an appropriate working temperature and then can be pressurized and injected into a well bore.

The heating assembly 10 can also be used in a variety of other applications. For example, the heating assembly can be used in a variety of different industrial processes requiring a relatively large supply of a heated fluid, for heating a building, or for rapidly boiling water. In alternative embodiments, a plasma generator 114 can be used apart from the heat exchanger 12 for a variety of applications where heat from plasma can be utilized. For example, the plasma generator 114 can be used as a plasma torch for cutting metal, burning or incinerating material, such as trash or waste, or for various other uses.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. I therefore claim as my invention all that comes within the scope and spirit of these claims.

I claim:

1. A heating apparatus for heating a fluid comprising:

a plasma generator;

a conduit extending from the plasma generator and configured to receive plasma and/or plasma exhaust from the plasma generator;

a conduit housing surrounding the conduit and having an inlet and an outlet, wherein a fluid to be heated can flow into the conduit housing via the inlet, over the conduit, and out of the conduit housing via the outlet, wherein the fluid flowing over the conduit is heated by the plasma and/or plasma exhaust in the conduit;

wherein the conduit comprises a burn chamber and a coil, the burn chamber extending from the plasma generator and configured to receive plasma from the plasma generator, wherein the coil extends from the burn chamber and is configured to receive plasma and/or plasma exhaust from the burn chamber;

wherein the plasma generator comprises at least three plasma generators;

wherein the conduit comprises at least three conduits, each comprising a burn chamber and a coil, wherein each burn chamber extends from a respective one of the three plasma generators and is configured to receive plasma from the respective one of the three plasma generators;

wherein each coil extends from a respective one of the three burn chambers and is configured to receive plasma and/or plasma exhaust from the respective one of the three burn chambers, and wherein the conduit housing surrounds each of the three conduits; and an insert positioned within the conduit housing, wherein the three coils are positioned between an inner surface of the conduit housing and an outer surface of the insert, wherein each coil extends around the outer surface of the insert.

2. The apparatus of claim 1, wherein:

each plasma generator extends partially into one of the burn chambers; and the apparatus further comprises a heat sink mounted co-axially on each plasma generator and positioned within the housing.

3. The apparatus of claim 1, further comprising:

an electrical power supply, wherein the electrical power supply supplies electrical power to the plasma generators; and an air compressor, wherein the air compressor feeds compressed air to the plasma generators.

4. The apparatus of claim 3, further comprising a controller unit configured to control a voltage, a current, and a frequency of the electrical power supplied to the plasma generators.

5. The apparatus of claim 4, wherein the electrical power supply comprises an electrical generator having an engine.

6. A heating apparatus for heating a fluid comprising:

a plasma generator;

a conduit extending from the plasma generator and configured to receive plasma and/or plasma exhaust from the plasma generator;

a conduit housing surrounding the conduit and having an inlet and an outlet, wherein a fluid to be heated can flow into the conduit housing via the inlet, over the conduit, and out of the conduit housing via the outlet, wherein the fluid flowing over the conduit is heated by the plasma and/or plasma exhaust in the conduit;

an electrical power supply, wherein the electrical power supply supplies electrical power to the plasma generator;

an air compressor, wherein the air compressor feeds compressed air to the plasma generator;

a controller unit configured to control a voltage, a current, and a frequency of the electrical power supplied to the plasma generator;

wherein the electrical power supply comprises an electrical generator having an engine;

an engine exhaust heat exchanger configured to exchange heat between an exhaust produced by the engine and the fluid before the fluid flows into the conduit housing;

an engine coolant heat exchanger configured to exchange heat between a coolant used by the engine and the fluid before the fluid flows into the conduit housing; and a plasma exhaust heat exchanger configured to exchange heat between an exhaust received from the outlet of the conduit and the fluid before the fluid flows into the conduit housing.

7. The apparatus of claim 6, wherein a portion of the conduit has a coiled configuration.

8. The apparatus of claim 1, wherein each plasma generator comprises:

a casing;

an outer insulator positioned coaxially within the casing;

a cathode positioned coaxially within the outer insulator;

an inner insulator positioned coaxially within the cathode; and an anode positioned coaxially within the inner insulator.

9. A method of heating a fluid using the heating apparatus of claim 1, the method comprising:

generating plasma within each burn chamber; and allowing the fluid to flow through the housing and over each burn chamber, thereby receiving heat from the plasma.

10. The method of claim 9, wherein generating plasma comprises cyclically operating the plasma generators such that each plasma generator alternates between generating plasma and not generating plasma.

11. The method of claim 10, wherein the cycles of each of the plurality of plasma generators are coordinated such that plasma is constantly generated by the plurality of plasma generators.

12. The method of claim 9, wherein the fluid flows through an annular flow path between the burn chambers and the housing.

13. The apparatus of claim 8, wherein:

the inner insulator includes air channels extending along its length;

the cathode includes at least one inflow channel and at least one outflow channel for passing a coolant therethrough; and the anode comprises at least one internal coolant path comprising at least one inflow channel and at least one outflow channel for passing a coolant therethrough.

14. The apparatus of claim 13, wherein:

the anode further comprises a slug of heat-conducting material positioned at least partially within the coolant path.

15. The apparatus of claim 14, further comprising a heat sink mounted co-axially on the casing, the heat sink comprising a plurality of spaced apart fins.

* * * * *